United States Patent [19]

Diekmann et al.

[11] Patent Number: 4,993,401

[45] Date of Patent: Feb. 19, 1991

[54] CONTROL SYSTEM FOR GLASS-TOP COOKING UNIT

[75] Inventors: Helmut Diekmann, Menden; Günter Krohn, Hemer; Wilhelm Cramer, Sundern, all of Fed. Rep. of Germany

[73] Assignee: Cramer GmbH & Co., Kommanditgesellschaft, Menden, Fed. Rep. of Germany

[21] Appl. No.: 441,904

[22] Filed: Nov. 28, 1989

[30] Foreign Application Priority Data

Dec. 28, 1988 [DE] Fed. Rep. of Germany ..... 3844082

[51] Int. Cl.[5] ..... F24C 15/30

[52] U.S. Cl. ..... 126/39 E; 431/66; 431/77; 126/39 R; 126/39 BA

[58] Field of Search ..... 126/39 F, 39 R, 39 H, 126/39 N, 39 BA; 431/45, 46, 47, 48, 59, 66, 77, 255; 251/129.01, 129.05

[56] References Cited

U.S. PATENT DOCUMENTS

| | | | |
|---|---|---|---|
| 3,898,439 | 8/1975 | Reed et al. | 364/494 |
| 3,958,791 | 5/1976 | Carlson | 251/129.01 |
| 4,402,663 | 9/1983 | Romanelli et al. | 431/71 X |
| 4,444,551 | 4/1984 | Mueller et al. | 431/66 X |
| 4,529,373 | 7/1985 | Ortlinghaus | 431/45 X |
| 4,681,084 | 7/1987 | Grech | 126/52 |
| 4,706,703 | 11/1987 | Takeuchi et al. | 251/129.05 X |
| 4,891,004 | 1/1990 | Ballard et al. | 126/116 A |

*Primary Examiner*—Larry Jones

*Attorney, Agent, or Firm*—Herbert Dubno; Andrew Wilford

[57] ABSTRACT

A cooking unit has a ceramic cooking surface, a gas burner underneath the surface, a gas supply including a solenoid valve for feeding a combustible gas to the burner, and an electric igniter juxtaposed with the burner and electrically energizable to ignite the combustible gas issuing from the burner. An electricity supply is connected to the igniter and to the gas supply for electrically energizing the igniter whenever the valve is open and supplying gas to the burner. In addition an electronic controller connected to the valve and to the electric supply monitors current consumption of the igniter and closes the valve when the current consumption of the igniter indicates same is malfunctioning. The controller includes a digital circuit that is also typically operated by the user of the cooker to turn the burners on and off and control their temperatures and an analog circuit connected parallel to each other. At least one of these circuits controls opening and closing of the valve. One of these arrangements is provided with a temperature display.

4 Claims, 2 Drawing Sheets

CONTROL SYSTEM FOR GLASS-TOP COOKING UNIT

FIELD OF THE INVENTION

The present invention relates to a ceramic-topped cooking unit. More particularly this invention concerns a control system for such a cook top.

BACKGROUND OF THE INVENTION

In a standard glass-plate or ceramic cooking unit the cooking pots and pans are set down directly on locations on a ceramic panel under which are respective gas burners. Each of these burners is associated with a respective igniter typically constituted as a resistive wire that is heated by passing an electric current through it and that is positioned in the path of the gas issuing from the respective burner so that such gas is ignited by it. The amount of gas fed to each burner is controlled by a respective valve having an indicator and also usually associated with a temperature-responsive controller to maintain a desired temperature in the respective burner.

Normally the igniter is energized only when the respective burner is turned on to ignite it. In order to ensure that the flame is properly lit, since failure to ignite would not be as readily noticed as on an open-flame system, it is standard to place in parallel to the on/off switching contacts for each burner a switching circuit or the like that itself is closed when the respective burner is turned on but that remains closed until a temperature sensor associated with the respective burner location on the ceramic panel determines that the respective location has reached the desired temperature. Such a supplementary igniter-control system is fairly expensive and constitutes another heat-exposed element that can fail and require servicing.

OBJECTS OF THE INVENTION

It is therefore an object of the present invention to provide an improved ceramic-panel cooking unit.

Another object is the provision of such an improved ceramic-panel cooking unit which overcomes the above-given disadvantages, that is which ensures that the burner is lit and which shuts the burner down in the event it goes out or the control system fails.

SUMMARY OF THE INVENTION

The cooking unit according to this invention has a ceramic cooking surface, a gas burner underneath the surface, a gas supply including a solenoid valve for feeding a combustible gas to the burner, and an electric igniter juxtaposed with the burner and electrically energizable to ignite the combustible gas issuing from the burner. An electricity supply is connected to the igniter and to the gas supply for electrically energizing the igniter whenever the valve is open and supplying gas to the burner. In addition according to this invention an electronic controller connected to the valve and to the electric supply monitors current consumption of the igniter and closes the valve when the current consumption of the igniter indicates same is malfunctioning.

According to this invention the controller includes a digital circuit that is also typically operated by the user of the cooker to turn the burners on and off and control their temperatures and an analog circuit connected parallel to each other. At least one of these circuits controls opening and closing of the valve. One of these arrangements is provided with a temperature display.

In accordance with a further feature of the invention the igniter has a temperature characteristic with a predetermined slope, either rising or falling. The controller shuts off the valve when its current consumption falls outside a predetermined range. Normally the resistance of the igniter changes as it heats up so that the current consumption or voltage across this igniter can be monitored to ascertain its temperature. A pair of operational amplifiers operating as threshold devices can be used. These two operational amplifiers have their outputs connected together, but one is set to output a signal to shut off the gas valve when its input, which is proportional to the igniter current consumption, goes below a predetermined level and the other is set to output such a signal when the same input goes above a predetermined level. The spread between these two levels constitutes a window or the range corresponding to the temperature of the igniter when the respective burner is properly lit.

The digital circuit can comprise a user-operated controller including a microprocessor connected to the valve for controlling flow of gas through the valve in accordance with the desired temperature of the surface at the burner. The microprocessor periodically opens and closes the valve to maintain a steady temperature at the respective burner.

The instant invention therefore maintains the igniter hot to ensure that even if gas flow is momentarily interrupted or some other untoward event occurs, the gas issuing from the burner will be ignited. In the unlikely event of failure of the igniter, the control circuit detects such failure and shuts down the respective valve. Replacing the igniter is a fairly simple repair.

DESCRIPTION OF THE DRAWING

The above and other objects, features, and advantages will become more readily apparent from the following, reference being made to the accompanying drawing in which.

SPECIFIC DESCRIPTION

Figure 1:
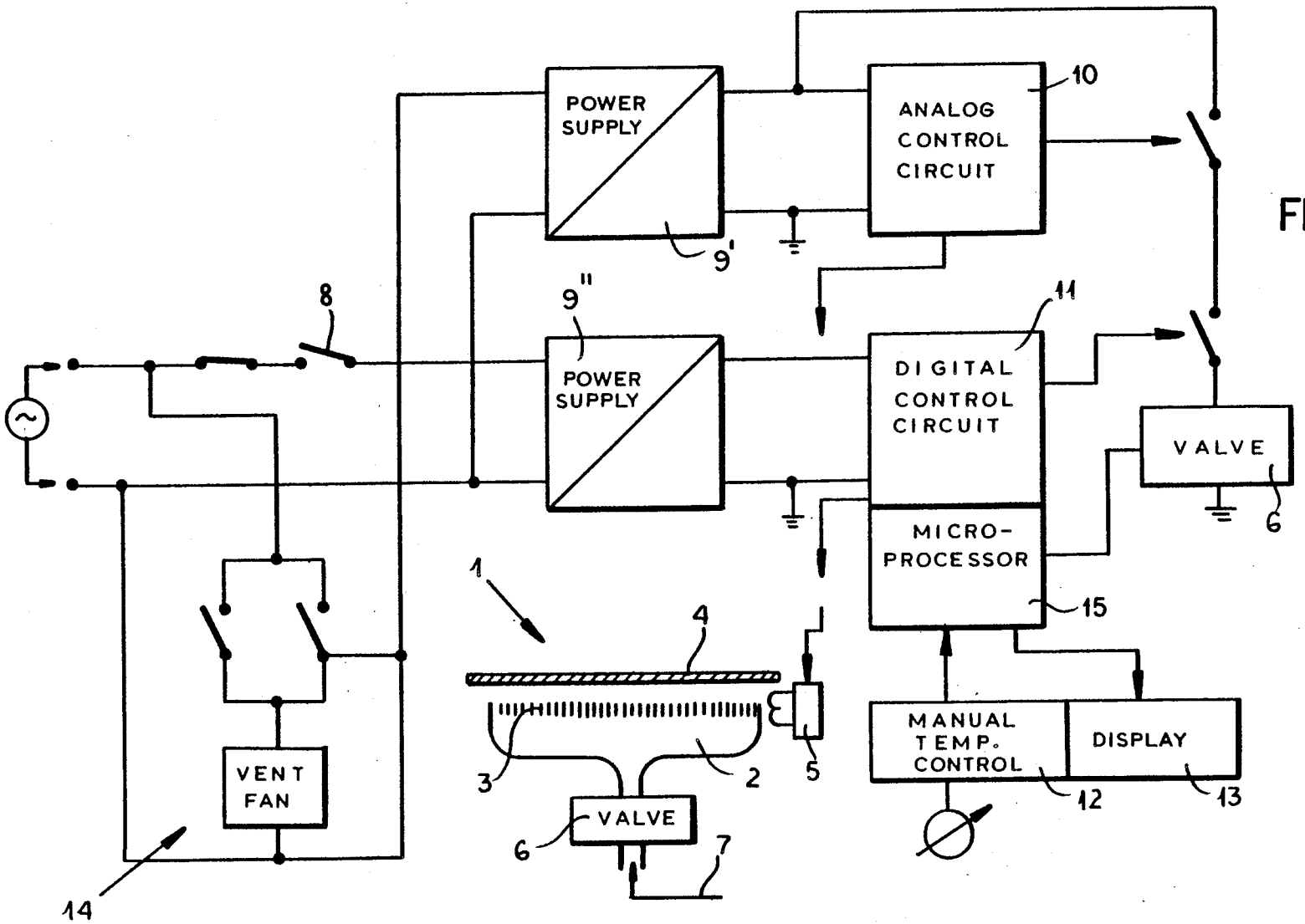
FIG. 1 is a block diagram of the cooking unit and its controllers according to this invention.

As seen in FIG. 1 a cooking unit 1 has a gas burner 2 with a nozzle plate 3 arranged immediately underneath a heat-resistant glass panel 4. Normally, several such burners 2 are provided under the panel 4, but here only one is shown for simplicity of description. Juxtaposed with each of the nozzle plates 3 is a respective resistant-type igniter 5. Gas is supplied to the burner 2 from a feed line 7 via a flow-control valve 6.

The system basically comprises a pair of power supplies 9' and 9" respectively connected to analog and digital control circuits 10 and 11. In addition, FIG. 1 shows a manual control system 12 and a display 13 connected to the digital control circuit 11. The entire system can be turned on and off by a main switch 8 and a conventional vent fan 14 is provided.

Figure 2:
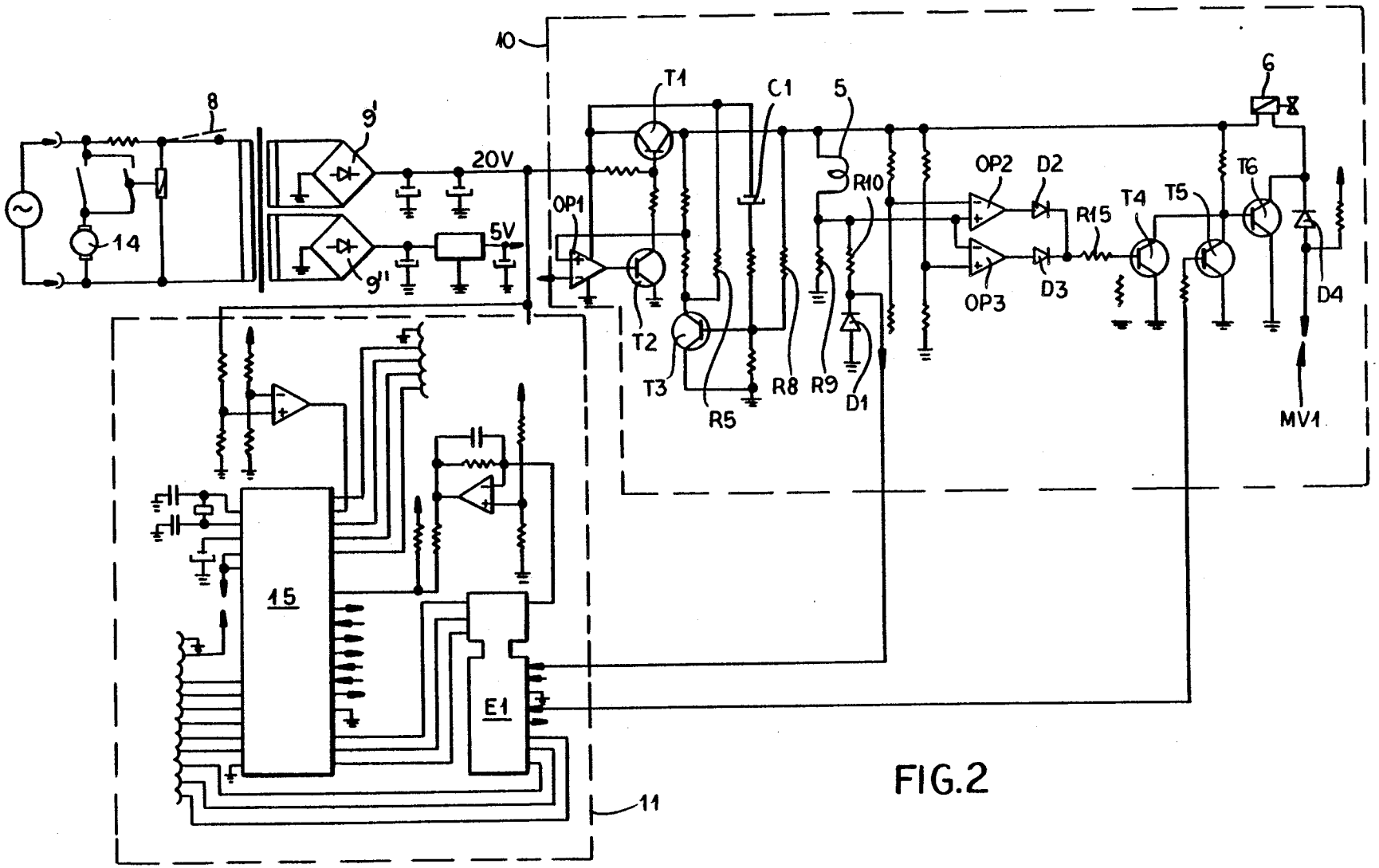
FIG. 2 is a schematic diagram of details of the system of FIG. 1.

According to this invention and as shown in better detail in FIG. 2, means is provided to energize the igniter 5 continuously whenever the respective valve 6 is open to feed gas to the burner 2. The FIG. 2 circuit is fed 20 volts from the respective power supply 9'. An operational amplifier OP1 along with transistors T1, T2, and T3 form a voltage-stabilizing circuit limiting the voltage on the collector of transistor T1 to 24 volts. If the collector of transistor T1 is shorted out to ground, transistor T3 stops conducting, this transistor T3 normally being rendered conductive via resistor R8. In this case the positive input of amplifier OP1 is switched high via a resistor R5 and the output of amplifier OP1 switches the transistor T1 off by means of the transistor T2. Thus if the igniter 5 or the valve 6 is shorted out the voltage to the igniter 5 and the voltage fed to the solenoid valve 6 is cut off. When turned on the transistor T3 is rendered conductive via the condenser C1 and voltage regulation starts at the collector of the transistor T1. When there is no short circuit on the collector of transistor T1 the transistor T3 remains conductive via resistor R8.

The operational amplifiers OP2 and OP3 are connected together to form a window-type discriminator that shuts off the valve 6 via the transistors T4 and T6 when current flow through the igniter 5 is greater than or less than a predetermined range. The current through the igniter 5 is subjected to a voltage drop through the resistor R9 connected in series with it.

When the current through the igniter 5 is too great so that the voltage across the resistor R9 exceeds the potential at the minus input of operational amplifier OP2 the diode D2 and resistor R15 conduct. The transistor T6 is no longer excited so that it cuts off the solenoid valve 6.

When the current through the igniter is too small or electric feed to the igniter is interrupted a higher voltage is applied to the positive input of amplifier OP3 than to its negative input. The output of amplifier OP3 makes the transistor T4 conductive via a diode D3 and a resistor R15. This also stops excitation of the transistor T6 and cuts off electric feed through the valve 6.

The illustrated circuit thus insures that when the igniter 5 is shorted out the entire current feed to the igniter and to the valve 6 is cut off. In addition if the current flow through the igniter 5, whose resistance and therefore current consumption will vary with its temperature, does not lie within the range defined by the amplifiers OP2 and OP3 the current flow through the valve 6 will be cut off to eliminate gas feed to the burners 2.

In addition to the above-described analog control of the igniter 5 the cooking unit 1 is provided with a micro-processor-type computer 15. The voltage drop across the resistor R9, which is proportional to the current flow through the igniter 5, is measured across a resistor R10 constituting an analog/digital convertor and is fed to the microprocessor 15. A diode D1 insures that the input voltage range of this analog/digital convertor is exceeded. When current flow through the igniter lies outside the permitted range an error signal is given out and the magnetic valve 5 will not be operated by the micro computer 15. The valve 16 is turned on and off by the computer 15 via transistors T5 and T6. The diode D4 determines whether or not the transistor T6 is conducting. When a low voltage is present at point MV1 even though the transistor T6 is not excited via the transistor T5 an error signal is emitted. When there is a short circuit of the supply voltage from power supply 9″ to the micro computer or the voltage drops below 5 volts there is no voltage at the negative input of amplifier OP1 and the supply voltage for the igniter 5 and the valve 6 will be shut off.

The input voltage at E1 is also monitored by the microcomputer 15. When it is too low the valve 16 cannot be operated and an error signal will be given out.

The temperature of the igniter 5 is a function of its load. As a result current flow through the igniter can only vary a limited amount with a given voltage interval.

We claim:

1. A cooking unit comprising:

a ceramic cooking surface;

a gas burner underneath the surface;

gas supply means including a solenoid valve for feeding a combustible gas to the burner;

an electric igniter juxtaposed with the burner and electrically energizable to ignite the combustible gas issuing from the burner;

electric supply means connected to the igniter and to the gas supply means for electrically energizing the igniter whenever the valve is open and supplying gas to the burner; and electronic control means connected to the valve and to the electric supply means for monitoring current consumption of the igniter and for closing the valve when the current consumption of the igniter indicates same is malfunctioning, the control means including a digital circuit and an analog circuit connected parallel to each other, both of these circuits including means for controlling opening and closing of the valve.

2. The cooking unit defined in claim 1 wherein the igniter has a temperature characteristic with a predetermined slope, the control means shutting off the valve when its current consumption falls outside a predetermined range.

3. The cooking unit defined in claim 1, further comprising a user-operated control means including a microprocessor connected to the valve for controlling flow of gas through the valve in accordance with the desired temperature of the surface at the burner.

4. The cooking unit defined in claim 3 wherein the microprocessor periodically opens and closes the valve.

* * * * *